US012612234B2

(12) United States Patent
Imafuku

(10) Patent No.: US 12,612,234 B2
(45) Date of Patent: Apr. 28, 2026

(54) CUSHIONING MATERIAL AND PACKAGING

(71) Applicant: Realize Company Inc., Tokyo (JP)

(72) Inventor: Yosuke Imafuku, Tokyo (JP)

(73) Assignee: Realize Company Inc., Tokyo (JP)

( * ) Notice: Subject to any disclaimer, the term of this patent is extended or adjusted under 35 U.S.C. 154(b) by 2 days.

(21) Appl. No.: 18/549,448

(22) PCT Filed: Feb. 24, 2022

(86) PCT No.: PCT/JP2022/007659
§ 371 (c)(1),
(2) Date: Oct. 6, 2023

(87) PCT Pub. No.: WO2022/190882
PCT Pub. Date: Sep. 15, 2022

(65) Prior Publication Data

US 2024/0174423 A1 May 30, 2024

(30) Foreign Application Priority Data

Mar. 8, 2021 (JP) ..... 2021-036456

(51) Int. Cl.
*B65D 81/05* (2006.01)
*B65D 81/02* (2006.01)

(52) U.S. Cl.
CPC ..... *B65D 81/052* (2013.01); *B65D 81/022* (2013.01)

(58) Field of Classification Search
CPC ..... B65D 81/052; B65D 81/022
(Continued)

(56) References Cited

U.S. PATENT DOCUMENTS 4,573,202 A * 2/1986 Lee ..... A45C 13/021 190/125
5,996,798 A * 12/1999 Gessert ..... B65D 81/052 206/521

(Continued)

FOREIGN PATENT DOCUMENTS

CN 105416846 A 3/2016
CN 208581904 U 3/2019

(Continued)

OTHER PUBLICATIONS

Office Action issued in counterpart Japanese Patent Application No. 2021-036456 mailed on Jul. 16, 2024 (9 pages).

(Continued)

*Primary Examiner* — Steven A. Reynolds
(74) *Attorney, Agent, or Firm* — Osha Bergman Watanabe & Burton LLP

(57) ABSTRACT

The present invention addresses the problem of making it possible to repeatedly use a cushioning material that protects an object. Packaging 1 comprises a storage part 20 and a cushioning material having a bag-shaped body 10. The storage part 20 is a container of a material such as, for example, plastic. The storage part 20 has an opening 21. The storage part 20 allows an object such as a camera to be stored, from the opening 21. The cushioning material having the bag-shaped body 10 is provided. If a first condition (such as a lid 23 of the storage part having been closed) is satisfied, the bag-shaped body 10 inflates and applies a prescribed pressure to a camera A to support the camera A, and if a second condition (such as the lid 23 of the storage part 20 having been opened) is satisfied, the bag-shaped body deflates to release the pressure on the camera A. The above problem is thus resolved.

8 Claims, 2 Drawing Sheets

(58) Field of Classification Search
USPC ..... 206/522
See application file for complete search history.

(56) References Cited

U.S. PATENT DOCUMENTS

| | | | | |
|---|---|---|---|---|
| 8,319,630 | B1 * | 11/2012 | Salwan | A45C 15/06 383/61.3 |
| 10,233,005 | B1 * | 3/2019 | De Bonet | B65D 81/052 |
| 2006/0108256 | A1 * | 5/2006 | Bussey | B65D 5/606 53/472 |
| 2007/0187278 | A1 * | 8/2007 | Krachtus | B65D 81/052 206/522 |
| 2009/0230006 | A1 * | 9/2009 | Pidgley | A45C 13/02 206/521 |
| 2011/0284417 | A1 * | 11/2011 | Duong | B65D 81/052 206/522 |
| 2012/0006714 | A1 | 1/2012 | Kasiwabara | |
| 2017/0320650 | A1 * | 11/2017 | Aguilar | B65D 81/03 |
| 2018/0050856 | A1 * | 2/2018 | Baud | B65D 35/08 |
| 2021/0309435 | A1 * | 10/2021 | Zhang | B65D 81/03 |
| 2023/0090955 | A1 * | 3/2023 | Endrizzi | F25D 3/06 206/522 |
| 2023/0192382 | A1 * | 6/2023 | Searle | B64G 5/00 206/522 |

FOREIGN PATENT DOCUMENTS

| | | | |
|---|---|---|---|
| JP | H08-324663 | A | 12/1996 |
| JP | H09-099979 | A | 4/1997 |
| JP | H11-130148 | A | 5/1999 |
| JP | 2002-104523 | A | 4/2002 |
| JP | 2006-219183 | A | 8/2006 |
| JP | 2007-276806 | A | 10/2007 |
| JP | 2016-043934 | A | 4/2016 |
| JP | 2020-104927 | A | 7/2020 |
| TW | 201103834 | A1 | 2/2011 |
| WO | 2011126009 | A1 | 10/2011 |

OTHER PUBLICATIONS

International Search Report issued in PCT/JP2022/007659 on Apr. 19, 2022 (5 pages).
Written Opinion of the International Searching Authority issued in PCT/JP2022/007659 on Apr. 19, 2022 (3 pages).
Extended European Search Report issued in Application No. 22766841.5, dated Jan. 14, 2025 (8 pages).
Office Action issued in Chinese Patent Application No. 202280019945.0; Dated Jul. 30, 2025 (12 pages).
Office Action issued in European Patent Application No. 22766841.5; Dated Aug. 22, 2025 (8 pages).

* cited by examiner

CUSHIONING MATERIAL AND PACKAGING

TECHNICAL FIELD

The present invention relates to a cushioning material and a packaging.

BACKGROUND ART

When an article is to be delivered, it is common to put the article in a wrapping material such as a corrugated box, to stuff voids with a cushioning material such as Styrofoam, an air bag, or the like, to prevent the article from moving, and to ship the packaging. In particular, when the article is, for example, a precision machinery such as a camera, it is common to place the article in a box one size larger than the article, and to sandwich it with cushioning materials having high cushioning properties and matching with the shape of the article, to protect it, and then send it. For example, in a case where the article is a rental product or the like, the rental product or the like will need to be transported twice, once for renting and once for returning, and the renting is carried out from a store and the returning is carried out from a general user in many cases. At the time point of returning the article, a packing material (e.g., a wrapping material and a cushioning material, which is a content thereof, or the like,) used at the time of renting may already be discarded in some cases. As such, another packing material has to be newly delivered, and then the article will be housed in it and sent back.

CITATION LIST

Patent Document

Patent Document 1: Japanese Unexamined Patent Application, Publication No. 2020-104927

DISCLOSURE OF THE INVENTION

Problems to be Solved by the Invention

As described above, in a case where the article is a rental product or the like, the rental product or the like will need to be transported twice, once for renting and once for returning, and it is necessary to procure a packing material every time the article is transported, which increases costs. In addition, Styrofoam, an air bag, and the like are often discarded as used materials after the article has been transported, which is not preferable from an environmental point of view.

The present invention has been made in view of the above circumstances, and an object of the present invention is to make it possible to repeatedly use a cushioning material for protecting an article.

Means for Solving the Problems

In order to achieve the above object, a cushioning material according to an embodiment of the present invention includes:

a variable body that inflates and applies a predetermined pressure on an object when a first condition is satisfied and deflates and releases the pressure on the object when a second condition is satisfied. A packaging according to the embodiment of the present invention includes:

a housing section having an opening, through which the object can be housed;

a lid provided in the housing section to be openable and closable, allowing the lid to close the opening when the lid is closed; and a cushioning material disposed in the housing section.

Effects of the Invention

According to the present invention, the cushioning material for protecting an object can be repeatedly used.

PREFERRED MODE FOR CARRYING OUT THE INVENTION

Figure 1:
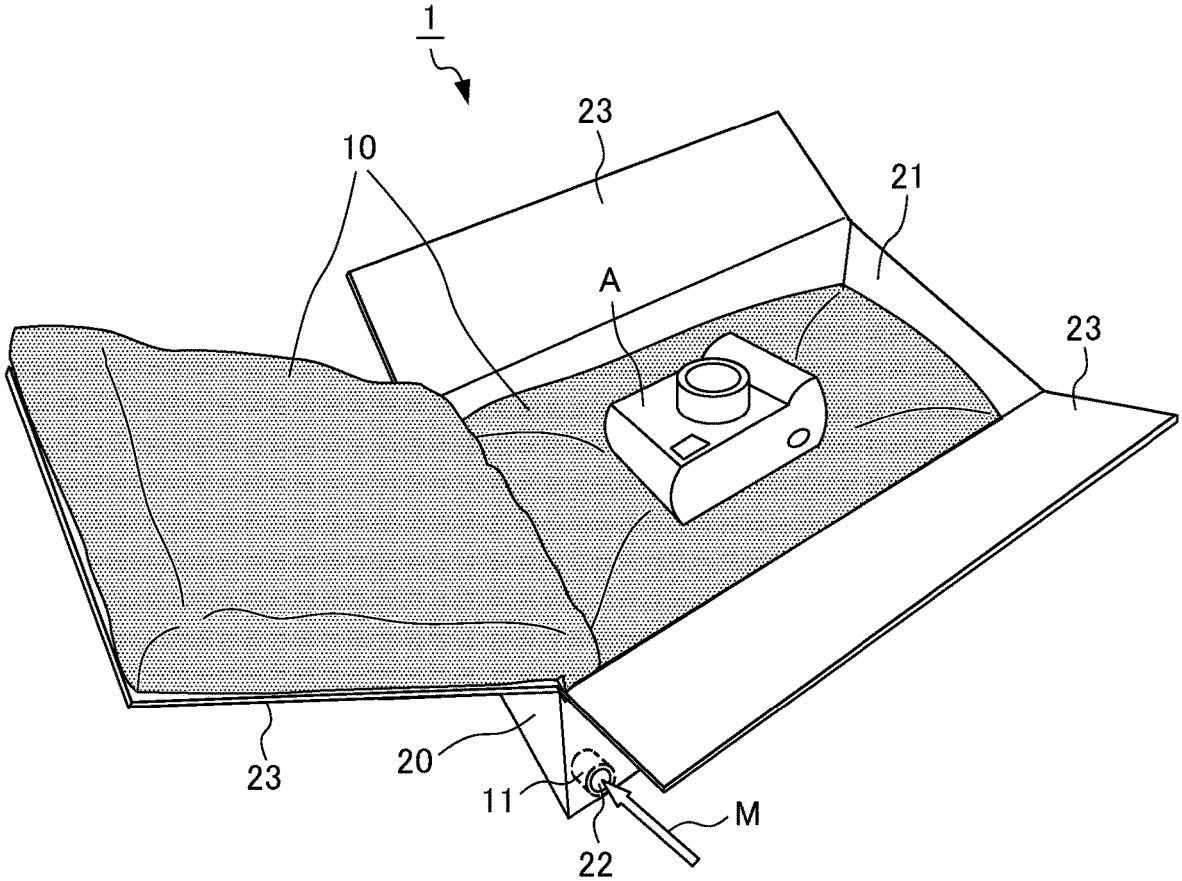
FIG. 1 is a diagram showing an overall configuration of a package according to an embodiment of the present invention.
Figure 2:
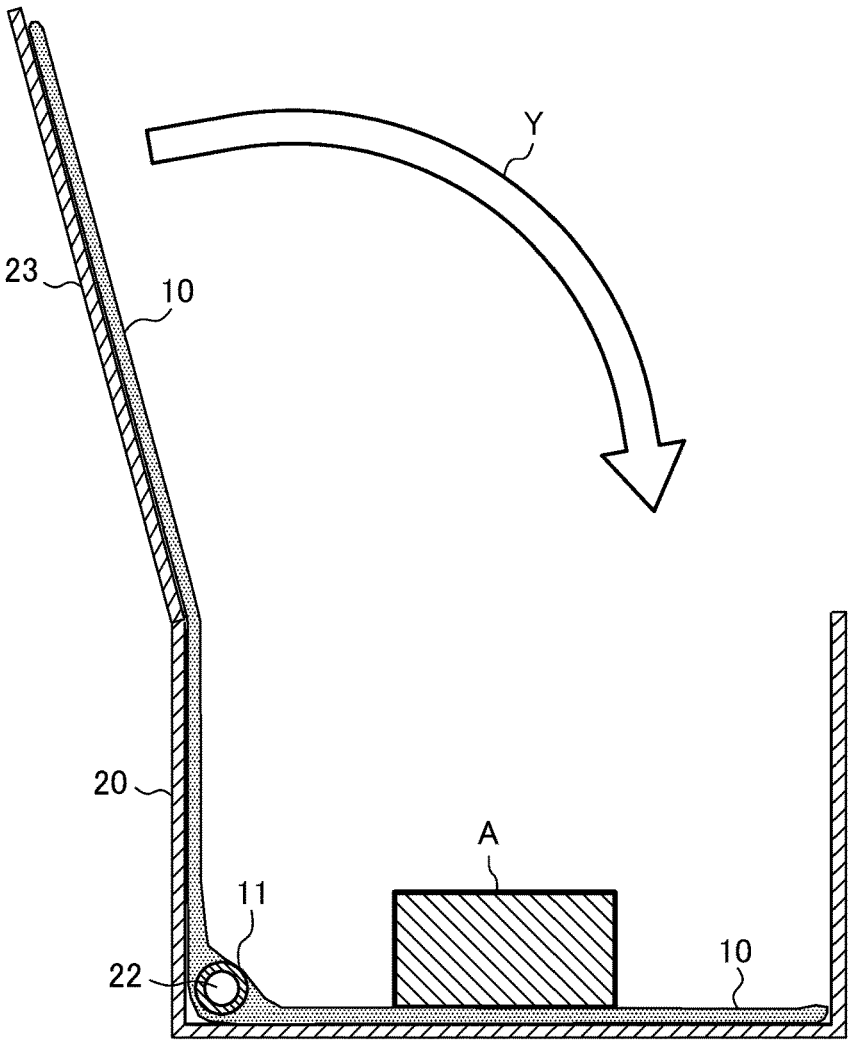
FIG. 2 is a diagram showing a cross-sectional view of the package in FIG. 1 in a state in which an object has been housed in the package and the lid is before being closed.
Figure 3:
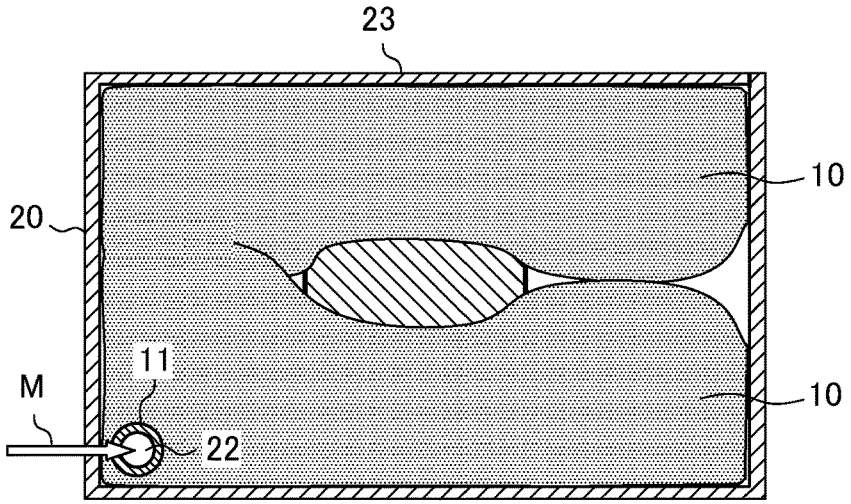
FIG. 3 is a diagram showing a cross-sectional view of the package in a state in which air has flown into the cushioning material after closing the lid from the state before being closed of FIG. 2.

Hereinafter, embodiments of the present invention will be described with reference to drawings. FIG. 1 is the diagram showing the overall configuration of the package according to the embodiment of the present invention. FIG. 2 is the diagram showing the cross-sectional view of the package in FIG. 1 in a state in which an object has been housed in the package and the lid is before being closed. FIG. 3 is the diagram showing the cross-sectional view of the package in a state in which air has flown into the cushioning material after closing the lid from the state before being closed of FIG. 2. Although FIG. 1 shows an example in which the cushioning material is inflated while the lid is opened in order to make it easier to understand the internal structure of the housing section, the cushioning material is typically inflated while the lid of the housing section is closed. A package 1 shown in FIG. 1 includes a housing section 20. The housing section 20 is a box-shaped container made of a material such as plastic. The housing section 20 has an opening 21. The housing section 20 can house an object such as a camera A through the opening 21.

A lid 23 is provided in the housing section 20, in a manner that the lid can be opened and closed. The lid 23 can occlude the opening 21 when closed. The lid 23 frees the opening 21 when opened. A cushioning material such as a bag-shaped body 10 is disposed inside the housing section 20.

The bag-shaped body 10 has a bag-like shape and is formed of a material such as stretch film, and a space inside the bag-shaped body 10 can be filled with a fluid such as air M through the opening. The opening has a check valve 11 attached thereto, and the air M once having flowed into the bag-shaped body 10 does not leak by the action of the valve. By performing a predetermined operation for releasing the check valve 11, it is possible to cause the air M in the bag-shaped body 10 to flow out. The predetermined operation can be interlock with, for example, the release of the lid 23. The operation of opening the valve of the check valve 11 may be manually performed. When the first condition is satisfied, the bag-shaped body 10 inflates and applies a predetermined pressure on the camera A, and when the second condition is satisfied, the bag-shaped body 10 deflates and releases the predetermined pressure on the camera A.

Specifically, once the first condition (a specific example will be described later with reference to FIGS. 2 and 3) is satisfied, the air M flows into the inside of the bag-shaped body 10 through the check valve 11, and the bag-shaped body 10 inflates in the housing section 20 and applies a predetermined pressure on the camera A in the closed space, to support the camera A.

In this example, the bag-shaped body 10 is disposed on inner surfaces from the bottom portion to one side surface of the housing section 20, and partially on an inner surface of the lid 23, to form a U-shaped cross section when the lid 23 is closed. That is, in the state in which the camera A is housed, the top and bottom surfaces and one side surface of the camera A are surrounded by the bag-shaped body 10. When the bag-shaped body 10 is inflated in the state in which the camera A is housed in the housing section 20, the camera A will be wrapped up by the bag-shaped body 10 (see FIG. 3).

As shown in FIG. 2, by fixing the bag-shaped body 10 along the inner bottom surface and the inner side surface of the housing section 20, and the inner surface of the lid 23 above the inner side surface and providing the bag-shaped body 10 with the check valve 11 at the corner portion of the housing section 20, the number of inflow and outflow ports of the air M can be reduced to one, so that the risk of damage to the inflow and outflow ports of the air M can be reduced. In addition to the shape shown here, the bag-shaped body 10 can be arranged in other shapes. For example, the bag-shaped body 10 may have a shape surrounding four sides of the camera A, i.e., upper, lower, left, and right sides of the camera A (a cross-section with a square shape). In this case, an object is housed in a direction, for example, from a side surface.

Further, once the second condition is satisfied, the air inside the bag-shaped body 10 flows out through the check valve 11, and the bag-shaped body 10 deflates and releases the pressure on the camera A.

The first condition is, for example, a condition that the lid 23 of a container such as the housing section 20 is closed. The opening and closing of the lid 23 is detected by a push switch, a contact sensor of the lid 23, or the like. The second condition is, for example, a condition that the lid 23 of the container such as the housing section 20 is opened. Opening and closing of the lid 23 is detected by a sensor, a switch, or the like provided in the housing section 20. Examples of the sensor and the switch include a push switch pressed by the closed lid 23 and a contact sensor that detects contact with the lid 23.

The check valve 11 is connected, during packing, to an external air pump (not shown) through a hole 22 provided in a side surface of the housing section 20. When the first condition is satisfied, the check valve 11 causes the fluid such as the air M to flow into the bag-shaped body 10. When the second condition is satisfied, the check valve 11 causes the air M to flow out from the bag-shaped body 10.

In the package 1 of this embodiment, as shown in FIG. 2, the bag-shaped body 10 capable of increasing or decreasing its volume (capacity) is disposed in the interior of the housing section 20 and partially on the lid 23. Specifically, the bag-shaped body 10 is fixed to the inner wall of the housing section 20 by an adhesive or the like. At this time, since the bag-shaped body 10 is not filled with the air M, the bag-shaped body 10 is in a deflated state, i.e., a state in which the bag-shaped body 10 becomes substantially flat on the bottom surface of the housing section 20 or on the inner surface of the lid 23. In this state, for example, the camera A, which is a rental product, is placed on the bag-shaped body 10 on the bottom in the housing section 20.

When packing, once the lid 23 is closed in the direction of an arrow Y and fixed by a gum tape or the like in order for the lid 23 not to open, the air M flows into the bag-shaped body 10 from an air pump connected to the check valve 11 and the bag-shaped body 10 is inflated. The action itself of introducing the air M may be manually performed.

As a result, as shown in FIG. 3, the inflated bag-shaped body 10 wraps around the camera A, and the camera A is supported in a state in which pressure is applied from the surroundings inside the housing section 20. Then, the package 1 including the camera A housed therein is delivered to a rentee by a distributor or the like.

Once the lid 23 is opened at the time of opening of the package 1 by the rentee, the check valve 11 is released, air flows out from the bag-shaped body 10, and the bag-shaped body 10 deflates. Thus, the pressure on the camera is eliminated, and the camera A can be safely taken out. The package 1 from which the camera A has been taken out can be recovered by the distributor as it is, or can be returned in the rental operation by the rentee, that is, the rentee can return the camera A by housing the camera A in the package 1.

As described above, according to the package 1 of the embodiment, since the packing material including the cushioning material that has been discarded so far can be repeatedly used, transportation costs of objects such as the camera A can be reduced. Further, by eliminating disposal of the packing materials such as the cushioning material and the wrapping material, it is possible to contribute to the protection of the natural environment.

Although the embodiment of the present invention has been described above, the present invention is not limited to the above embodiment, and modifications, improvements, and the like are included in the present invention as long as the object of the present invention can be achieved.

In addition, in this specification, the term "system" means an overall apparatus formed of a plurality of apparatuses, a plurality of means, and the like.

In the above-described embodiment, the housing section 20 is described as a container made of, for example, a plastic material, but may be other than the above, i.e., a container made of a material having light weight and strength, such as glass fiber, a conventional corrugated board, wood, metal, or the like. Any housing section formed of a material having a certain degree of strength and formed so as to be capable of housing an object is sufficient.

In the above-described embodiment, the housing section 20 is in the shape of a box, but any packaging for an object (for example, the camera A) is sufficient regardless of the shape. In the above embodiment, the bag-shaped body 10 made of a material such as a stretch film is exemplified as an example of the variable body whose volume varies, but the present invention is not limited thereto. Any variable body that is made of a material having elasticity, stretchability, and strength and that can reversibly vary its capacity, such as a rubber balloon or a vinyl float ring, is sufficient. The variable body (the bag-shaped body 10) may have a reinforcing coating on its surface so as not to become damaged even if the object to be housed has a protrusion. The arrangement, shape, and number of the variable bodies may also be another arrangement, shape and number. The number of check valves 11 is not limited to one, and a plurality of check valves 11 may be provided. For example, bag-shaped bodies 10 may be provided on each of the bottom surface and the top surface inside the housing section 20, and the check valves 11 may be provided on each of the bag-shaped bodies 10, so that air may be uniformly supplied from two check valves 11 to sandwich the object from above and below. Alternatively, the bag-shaped body 10 may be provided on each of the left and right side surfaces inside the housing section 20. If the housing section 20 is a rectangular parallelepiped, the bag-shaped body 10 may be provided on the entire six surfaces inside the housing section 20. As the cushioning materials are provided uniformly relative to the object, the stability when the object is supported can be more significantly improved.

Further, in the above-described embodiment, the air M or the like is exemplified as an example of substances to be contained in the bag-shaped body 10, but other variable bodies such as a liquid such as water, a gas, a granular body such as powder or sand, and a jelly-like or gel-like body can be used as long as the variable body can inflate the bag-shaped body 10 when the first condition is satisfied, and can deflate the bag-shaped body 10 when the second condition is satisfied. Further, the variable body may be two or more types of liquids that inflate when mixed and deflate when further another type of liquid is mixed. Further, the bag-shaped body 10 itself may be a variable body made of a material that self-inflates when the first condition is satisfied and self-deflates when the second condition is satisfied. The variable body may be a body that self-inflates or self-deflates at a given temperature and, further, may be a body that self-inflates or self-deflates depending on a supplied electric power.

In the above-described embodiment, for example, the camera A is exemplified as an example of the object, but the object may be other than the above, such as an electronic device, glassware, or the like and any object is sufficient.

Further, in the above-described embodiment, the first condition is that the lid 23 is closed, but may be that the inside of the housing section 20 becomes dark because the lid 23 has been closed, that the object is housed and packed, or the like. Conversely, the second condition is that the lid 23 is opened, but may be that the lid 23 is opened and the inside of the housing section 20 becomes brighter, that unpacking of the housing section 20 has begun, or the like.

In summary, the cushioning material and packaging to which the present invention is applied are sufficient as long as they have the following configurations, and can adopt various embodiments. That is, the cushioning material to which the present invention is applied includes:

a variable body (for example, the bag-shaped body 10, etc. of FIG. 1) that inflates and applies a predetermined pressure on an object (for example, the camera A), when the first condition (for example, the lid 23 of the housing section 20 of FIG. 1 is closed) is satisfied and deflates and releases the predetermined pressure on the object (for example, the camera A, etc.), when the second condition is satisfied (for example, the lid 23 of the housing section 20 of FIG. 1 is opened).

In this way, the cushioning material has a function that when the first condition (for example, the lid 23 of the container (for example, the housing section 20 of FIG. 1) is closed) is satisfied, the cushioning material inflates and applies a predetermined pressure on the object A (for example the camera A) to support it, and when the second condition (for example, the lid 23 of the housing section 20 of FIG. 1 is opened) is satisfied, the cushioning material deflates and releases the pressure on the object (for example the camera A), thereby allowing the package 1 in which the cushioning material is disposed to be used repeatedly. Thus, transportation costs of objects (e.g., the camera A) can be reduced. Further, since the number of packing materials to be discarded is reduced, a good environmental effect can be also obtained.

A packing to which the present invention is applied (e.g., the package 1 of FIG. 1) includes:

a housing section (for example, the housing section 20 in FIG. 1) having an opening (for example, the opening 21 in FIG. 1), through which the object (for example, the camera A) can be housed; and a lid (for example, the lid 23 in FIG. 1) provided at the opening (for example, the opening 21 in FIG. 1) and being capable of opening and closing the opening in the housing section (for example, the housing section 20, etc.). Inside the housing section (for example, the housing section 20 of FIG. 1), the cushioning material is disposed. Disposing a cushioning material which inflates and deflates inside the housing section (for example, the housing section 20 in FIG. 1) and making the cushioning material inflate so as to match with the shape of the object (for example, the camera A) housed in the housing section (for example, the housing section 20 in FIG. 1) enables the cushioning material which has been so far discarded at the transportation destination to be repeatedly used, this reduces the transportation costs of objects (for example, the camera A, etc.).

The first condition is that the lid (e.g., the lid 23 of FIG. 1) has been closed and the cushioning material includes a fluid inflow control unit (for example, the check valve 11 in FIG. 1) that allows the fluid (for example, the air M in FIG. 1) to flow into the variable body (for example, the bag-shaped body 10, in FIG. 1), when the first condition is satisfied. As described above, when the first condition is satisfied, the fluid (for example, the air M in FIG. 1) is caused to flow into the variable body (for example, the bag-shaped body 10 in FIG. 1) to inflate the variable body in the packaging, and pressure is applied on the object (for example, the camera A) to press the object, making it possible to prevent the object from moving during transportation and to protect the object (for example, the camera A) from vibrations generated during transportation or impacts generated inadvertently.

The second condition is that the lid (for example, the lid 23 of FIG. 1) has been opened, and the cushioning material includes a fluid outflow control unit (for example, the check valve 11 in FIG. 1) that allows the fluid (for example, the air M in FIG. 1) to flow out from the variable body (for example, bag-shaped body 10 in FIG. 1), when the second condition is satisfied. As described above, when the second condition is satisfied, by making the fluid (for example, the air M in FIG. 1) flow out of the variable body (for example, the bag-shaped body 10 in FIG. 1), the variable body (for example, the bag-shaped body 10 in FIG. 1) deflates in the packaging to release the predetermined pressure on the object (for example, the camera A), that is, to eliminate pressing, and thus the object (for example, the camera A) can be easily taken out from the package.

EXPLANATION OF REFERENCE NUMERALS

1 . . . Package, 10 . . . bag-shaped body, 11 . . . check valve, 20 . . . housing section, 21 . . . opening, 22 . . . hole, 23 . . . lid, A . . . camera, M . . . air

The invention claimed is:

1. A packaging comprising:

a housing section having an opening, through which an object can be housed, wherein the housing section comprises a container that is made of a packing material selected from a group consisting of plastic, corrugated board, and glass fiber, a lid provided in the housing section and being capable of opening and closing the opening, a push switch connected to the lid, wherein the push switch is configured to detect an opening of the lid and a closing of the lid, and wherein the housing section has a cushioning material disposed in the inside thereof, and a first check valve connected to the cushioning material and a hole in the housing section, wherein the cushioning material inflates and applies a predetermined pressure on an object in response to a first condition being satisfied, and deflates and releases the predetermined pressure on the object in response to a second condition being satisfied, wherein the first check valve provides an inflow port and an outflow port to the cushioning material, wherein the first check valve causes fluid to flow into the cushioning material in response to the push switch detecting that the lid is closed, wherein the first check valve causes fluid to flow out of the cushioning material in response to the push switch detecting that the lid is open, wherein the first condition corresponds to the lid being closed, and wherein the second condition corresponds to the lid being opened.

2. The packaging according to claim 1, wherein the cushioning material comprises a bag-shaped body that is fixed to an inner wall of the housing section by an adhesive.

3. The packaging according to claim 1, wherein the cushioning material comprises a variable body that forms a U-shaped cross section in response to the lid being closed.

4. The packaging according to claim 1, further comprising:

a second check valve connected to the cushioning material and a first hole in a first surface of the housing section, and wherein the first check valve is connected to the cushioning material and a second hole in a second surface that is opposite the first surface of the housing section.

5. The packaging according to claim 1, wherein the cushioning material is inflated using a granular-like body, and wherein the granular-like body is selected from a group consisting of sand or powder.

6. The packaging according to claim 1, wherein the cushioning material is inflated using a gel-like body.

7. A packaging comprising:

a housing section having an opening, through which an object can be housed, wherein the housing section comprises a container that is made of a packing material selected from a group consisting of plastic, corrugated board, and glass fiber, a lid provided in the housing section and being capable of opening and closing the opening, a contact sensor connected to the lid, wherein the contact sensor is configured to detect an opening of the lid and a closing of the lid, and wherein the housing section has a cushioning material disposed in the inside thereof, and a check valve connected to the cushioning material and a hole in the housing section, wherein the cushioning material inflates and applies a predetermined pressure on an object in response to a first condition being satisfied, and deflates and releases the predetermined pressure on the object in response to a second condition being satisfied, wherein the check valve provides an inflow port and an outflow port to the cushioning material, wherein the check valve causes fluid to flow into the cushioning material in response to the contact sensor detecting that the lid is closed, wherein the check valve causes fluid to flow out of the cushioning material in response to the contact sensor detecting that the lid is open, wherein the first condition corresponds to the lid being closed, and wherein the second condition corresponds to the lid being opened.

8. A packaging, comprising:

a housing section having an opening, through which an object is housed;

a lid provided in the housing section and being capable of opening and closing the opening; and a variable body that is disposed inside the housing section with the object, the variable body inflating when a fluid flows thereinto and deflating when the fluid flows thereout, wherein the variable body is disposed on inner surfaces from a bottom portion to one side surface of the housing section, and partially on an inner surface of the lid, wherein the variable body forms a U-shaped cross section such that top and bottom surfaces and one side surface of the object are surrounded by the variable body and the object is supported while being applied to a predetermined pressure, when the lid is closed, and wherein the variable body deflates such that the predetermined pressure on the object is released, when the lid is opened.

* * * * *